US010897103B1

(12) United States Patent
Sundarakrishnamachari et al.

(10) Patent No.: US 10,897,103 B1
(45) Date of Patent: Jan. 19, 2021

(54) ELECTRICAL CONNECTOR WITH SEAL PROTECTION

(71) Applicant: Aptiv Technologies Limited, St. Michael (BB)

(72) Inventors: Rangarajan Sundarakrishnamachari, Roypettah (IN); Velmurugan Kandasamy, Salem (IN)

(73) Assignee: APTIV TECHNOLOGIES LIMITED

( * ) Notice: Subject to any disclaimer, the term of this patent is extended or adjusted under 35 U.S.C. 154(b) by 0 days.

(21) Appl. No.: 16/568,945

(22) Filed: Sep. 12, 2019

(51) Int. Cl.

| | |
|---|---|
| ***H01R 43/18*** | (2006.01) |
| ***H01R 13/52*** | (2006.01) |
| ***H01R 13/506*** | (2006.01) |
| ***H01R 13/436*** | (2006.01) |
| ***H01R 43/20*** | (2006.01) |
| ***H01R 43/26*** | (2006.01) |
| ***H01R 43/00*** | (2006.01) |
| *H01R 13/625* | (2006.01) |

(52) U.S. Cl.
CPC ..... *H01R 13/5202* (2013.01); *H01R 13/4368* (2013.01); *H01R 13/506* (2013.01); *H01R 13/5219* (2013.01); *H01R 43/005* (2013.01); *H01R 43/18* (2013.01); *H01R 43/20* (2013.01); *H01R 43/26* (2013.01); *H01R 13/625* (2013.01)

(58) Field of Classification Search
CPC ..... H01R 13/5202; H01R 43/005; H01R 13/506; H01R 43/18; H01R 13/4368; H01R 43/26; H01R 43/20; H01R 13/5219; H01R 13/625
See application file for complete search history.

(56) References Cited

U.S. PATENT DOCUMENTS

| | | | | |
|---|---|---|---|---|
| 5,004,436 | A | 4/1991 | Aoyama | |
| 6,171,146 | B1 * | 1/2001 | Fink | H01R 13/4223 439/595 |
| 6,305,990 | B1 * | 10/2001 | Ward | H01R 13/432 439/752 |
| 7,628,648 | B1 * | 12/2009 | Tan Chin Yaw | H01R 13/4365 439/595 |
| 7,661,999 | B2 * | 2/2010 | Horiuchi | H01R 13/4362 439/595 |
| 7,892,010 | B2 * | 2/2011 | Lux | H01R 13/62938 439/342 |
| 9,407,026 | B2 | 8/2016 | Campbell et al. | |
| 9,755,349 | B1 * | 9/2017 | Kim | H01R 13/5202 |
| 9,917,381 | B1 | 3/2018 | Campbell et al. | |
| 2003/0096539 | A1 * | 5/2003 | Ichio | H01R 13/4362 439/752 |

(Continued)

FOREIGN PATENT DOCUMENTS

EP 3171459 A1 5/2017

*Primary Examiner* — Truc T Nguyen
(74) *Attorney, Agent, or Firm* — Robert Myers; Billion & Armitage

(57) ABSTRACT

An electrical connector includes first and second housing portions that are secured to one another and respectively provide an aperture and a hole. The aperture is configured to receive a terminal of a wire. The hole is configured to receive the wire. The first housing portion includes a face that is configured to mate with another connector that carries another terminal that is engageable with the terminal. A seal is captured between the first and second housing portions and is configured to engage the other connector.

20 Claims, 8 Drawing Sheets

(56) References Cited

U.S. PATENT DOCUMENTS

| | | | | |
|---|---|---|---|---|
| 2006/0040536 | A1* | 2/2006 | Putnam | H01R 13/641 439/157 |
| 2006/0105611 | A1* | 5/2006 | Toyoda | H01R 13/6272 439/353 |
| 2006/0154511 | A1* | 7/2006 | Okura | H01R 13/4538 439/372 |
| 2009/0191767 | A1* | 7/2009 | Mase | H01R 13/4362 439/752 |
| 2011/0021048 | A1* | 1/2011 | Sakamaki | H01R 13/62977 439/157 |
| 2011/0086544 | A1* | 4/2011 | Yoshioka | H01R 13/4362 439/587 |
| 2011/0217859 | A1* | 9/2011 | Kimura | H01R 13/52 439/271 |
| 2013/0224973 | A1 | 8/2013 | Midy | |
| 2013/0273764 | A1* | 10/2013 | Kitajima | H01R 13/4362 439/345 |
| 2014/0120762 | A1* | 5/2014 | Kuroda | H01R 13/4223 439/370 |
| 2014/0154910 | A1* | 6/2014 | Conway | H01R 13/5213 439/358 |
| 2015/0295357 | A1* | 10/2015 | Campbell | H01R 13/6272 439/352 |
| 2015/0364857 | A1* | 12/2015 | Endo | H01R 13/05 439/733.1 |
| 2017/0310040 | A1* | 10/2017 | Gagnon | H01R 13/443 |
| 2018/0342828 | A1* | 11/2018 | Kobayashi | H01R 13/5208 |
| 2018/0351280 | A1 | 12/2018 | Kosmalski et al. | |
| 2019/0157797 | A1* | 5/2019 | McDowell | H01R 13/506 |

* cited by examiner

ELECTRICAL CONNECTOR WITH SEAL PROTECTION

FIELD OF INVENTION

This disclosure relates to an electrical connector and seal.

BACKGROUND

Sealed connector assemblies are widely used in the automotive industry to protect the electrical wire terminals from dust, humidity, and water ingress. Typically a seal is arranged between male and female plastic connectors, which each carry the wire terminals. Due to the interference fit between the connectors, the seal may roll over during insertion or removal of the male connector relative to the female connector.

Terminal position assurance features are commonly used for automotive electrical connectors to provide additional locking for the terminals. One common secondary lock used to provide terminal position assurance is generally inserted from the outside of one of the connectors which has a large aperture to accommodate the secondary lock. Some types of secondary locks also may be configured to prevent the seal from rolling over.

SUMMARY

In one exemplary embodiment, an electrical connector includes first and second housing portions that are secured to one another and respectively provide an aperture and a hole. The aperture is configured to receive a terminal of a wire. The hole is configured to receive the wire. The first housing portion includes a face that is configured to mate with another connector that carries another terminal that is engageable with the terminal. A seal is captured between the first and second housing portions and is configured to engage the other connector.

In a further embodiment of the above, the first housing portion includes a guide wall that forms a pocket that receives the second housing portion. The guide wall circumscribes at least a portion of the second housing portion.

In a further embodiment of any of the above, the first and second housing portion includes complementary housing locking elements that secure the first and second housing portions to one another in a snap-fit relationship.

In a further embodiment of any of the above, the housing locking elements are provided by a clip with a window on one of the first and second housing portions. A tab on the other of the first and second housing portions is received in the window.

In a further embodiment of any of the above, the guide wall includes a gap that is configured to receive the clip. The tab is provided on the first housing portion. The guide wall abuts at least 50% of the seal.

In a further embodiment of any of the above, the connector includes a secondary lock that is carried by the first housing portion. The secondary lock is slideable between unlocked and locked positions. The secondary lock is configured to abut the terminal in the locked position and configured to permit insertion of the terminal into the aperture in the unlocked position.

In a further embodiment of any of the above, the secondary lock retains elements that secure the secondary lock to the first housing portion to provide a subassembly.

In a further embodiment of any of the above, the first housing portion includes a guide wall that forms a pocket that receives the second housing portion. The guide wall circumscribes at least a portion of the second housing portion. The secondary lock retains elements that are provided by a clip on the guide wall and a tab on a perimeter of the secondary lock. The tab is slideable relative to the clip between the locked and unlocked positions.

In a further embodiment of any of the above, the first housing and the secondary lock respectively include first and second protrusions. The second protrusion is arranged on one side of the first protrusion in the unlocked position. The second protrusion is arranged on an opposing side of the one side in the locked position.

In a further embodiment of any of the above, the connector includes the terminal that is arranged in the aperture. The aperture corresponds to a first aperture. The secondary lock includes an opening and includes a second aperture that provides a lip. The opening is configured to receive a tool that moves the secondary lock from the unlocked position to the locked position. The lip blocks the terminal in the locked position.

In another exemplary embodiment, a method of assembling an electrical connector includes inserting a secondary lock into a first housing portion to provide a subassembly. The method also includes arranging a seal on a second housing portion. The method further includes securing the first and second housing portions to one another and about the secondary lock. The method further includes capturing the seal between the first and second housing portions in response to the securing step.

In a further embodiment of any of the above, the first housing portion and the secondary lock respectively include first and second apertures aligned with one another. The method includes a terminal that is arranged in the first aperture. The method further includes a step of sliding the secondary lock from an unlocked position to a locked position to block the terminal from pulling past the second aperture with the secondary lock.

In a further embodiment of any of the above, the sliding step includes sliding a second protrusion past a first protrusion to the locked position.

In a further embodiment of any of the above, the inserting step includes snapping secondary lock retaining elements to one another.

In a further embodiment of any of the above, the securing step includes receiving the second housing portion in a pocket provided by a guide wall of the first housing portion. The guide wall provides a first shoulder and the second housing portion provides a second shoulder. The capturing step includes abutting the seal with the first and second shoulders.

In a further embodiment of any of the above, the securing step includes snapping housing locking elements to one another.

In a further embodiment of any of the above, the method includes a step of installing a second connector with a second terminal into the connector. The installing step includes electrically coupling the second terminal to the terminal and engaging the second connector with the seal.

In a further embodiment of any of the above, the method includes a step of rotating a lever to lock the connector and the second connector to one another.

In another exemplary embodiment, an electrical connector includes first and second housing portions that are secured to one another and respectively provide an aperture and a hole. The aperture is configured to receive a terminal of a wire. The hole is configured to receive the wire. The first housing portion includes a face that is configured to mate with another connector that carries another terminal that is engageable with the terminal. A secondary lock is carried by the first housing portion. The secondary lock is slideable between unlocked and locked positions. The secondary lock is configured to abut the terminal in the locked position and configured to permit insertion of the terminal into the aperture in the unlocked position.

In a further embodiment of any of the above, secondary lock retaining elements secure the secondary lock to the first housing portion to provide a subassembly. The first housing portion includes a guide wall that forms a pocket that receives the second housing portion. The guide wall circumscribes at least a portion of the second housing portion. The secondary lock retaining elements are provided by a clip on the guide wall and a tab on a perimeter of the secondary lock. The tab is slideable relative to the clip between the locked and unlocked positions. The first housing and the secondary lock respectively include first and second protrusions. The second protrusion is arranged on one side of the first protrusion in the unlocked position. The second protrusion is arranged on an opposing side of the one side in the locked position.

BRIEF DESCRIPTION OF THE DRAWINGS

The disclosure can be further understood by reference to the following detailed description when considered in connection with the accompanying drawings wherein.

The embodiments, examples and alternatives of the preceding paragraphs, the claims, or the following description and drawings, including any of their various aspects or respective individual features, may be taken independently or in any combination. Features described in connection with one embodiment are applicable to all embodiments, unless such features are incompatible. Like reference numbers and designations in the various drawings indicate like elements.

DETAILED DESCRIPTION

Figure 1A:
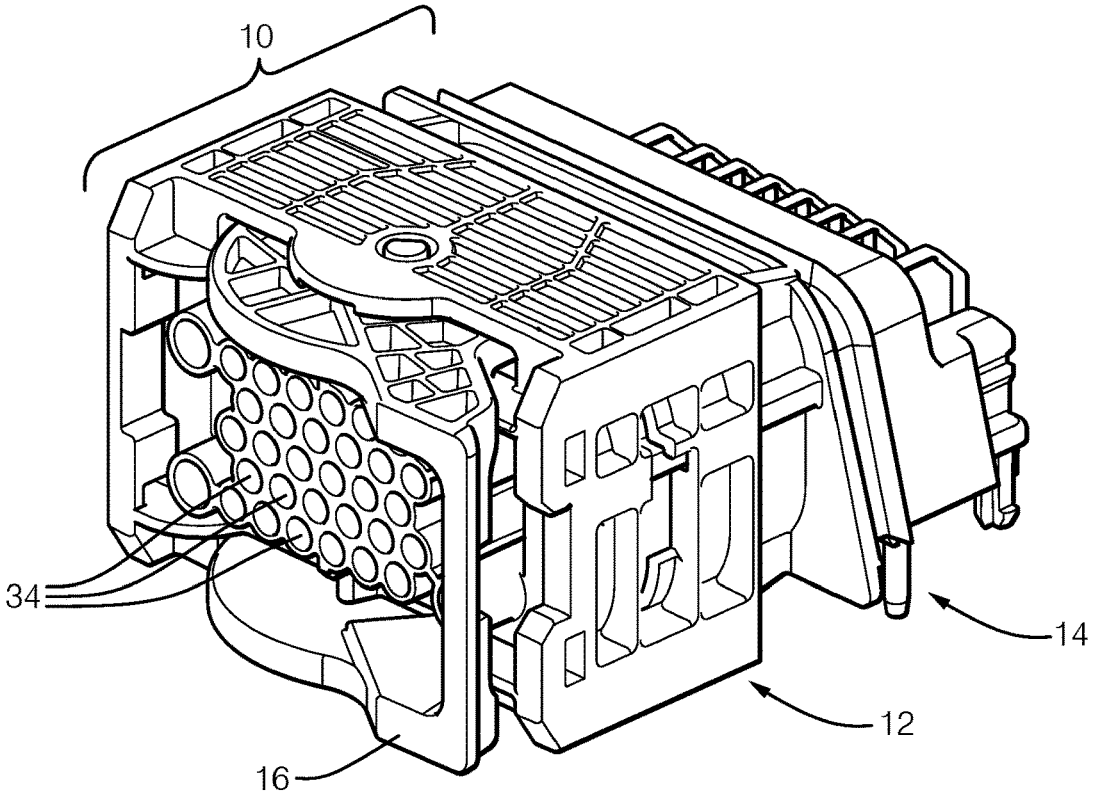
FIGS. 1A and 1B illustrate perspective views of first and second connectors secured to one another to provide an electrical connection.
Figure 1B:
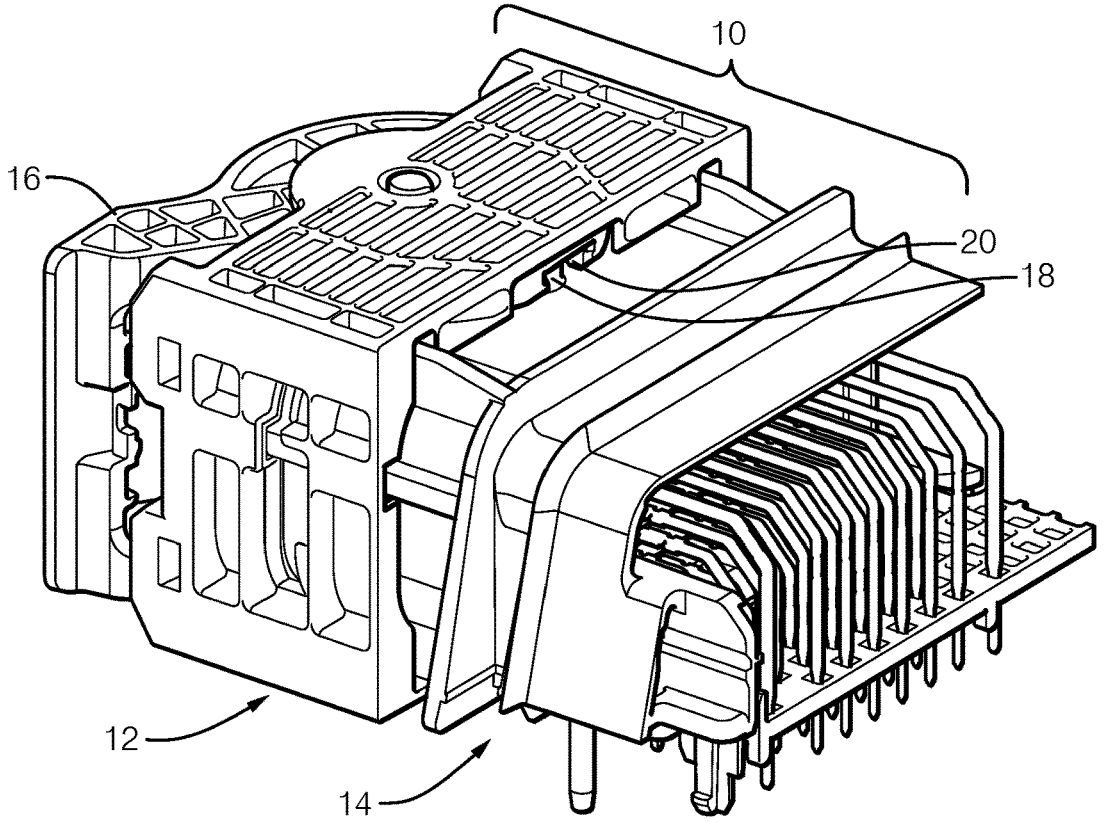

A connector assembly 10 is illustrated in FIGS. 1A and 1B having first and second connectors 12, 14 that create a secure electrical connection between multiple wires. In the example, the first connector 12 includes a lever 16 that has an arcuate slot 20 receiving a pin 18 provided on the second connector. When the first and second connectors 12, 14 are fully seated, the lever 16 may be rotated capturing the pin 18 within the slot 20.

Figure 2:
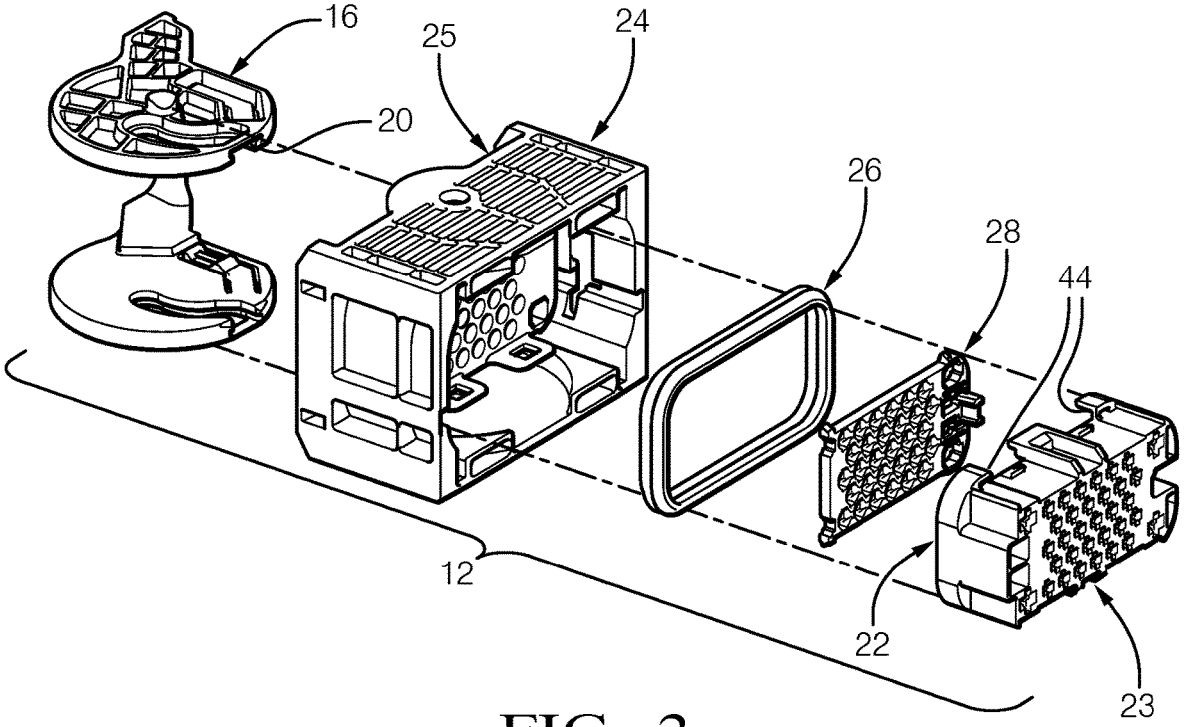
FIG. 2 is an exploded perspective view of the first connector shown in FIGS. 1A and 1B.
Figure 3:
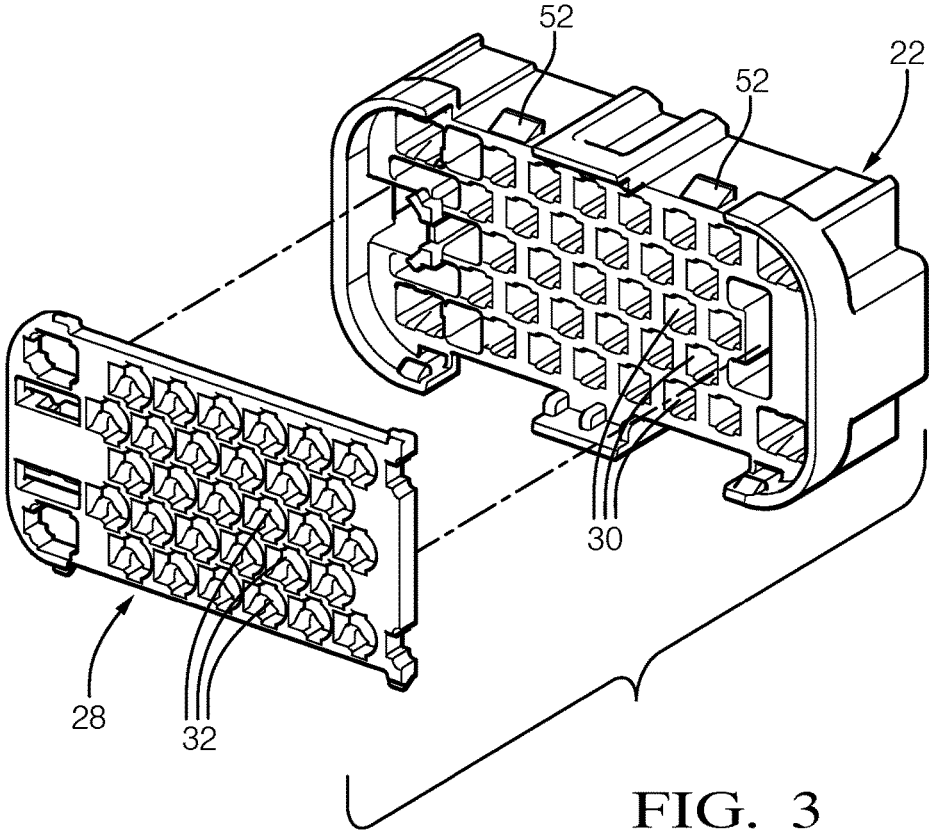
FIG. 3 is an enlarged exploded view of a first housing portion and a secondary lock illustrated in FIG. 2.

Referring to FIGS. 2 and 3, the first connector 12 includes first and second housing portions 22, 24. The first housing portion 22 includes a face 23 having multiple first apertures 30 within which wire terminals (68 in FIG. 12) are disposed. A secondary lock 28 is carried by the first housing portion 22 and is captured between the first and second housing portions 22, 24 when assembled. A seal 26 is also captured between the first and second housing portions 22, 24 and engages the second connector 14 when assembled to the first connector 12.

The first housing portion 22 includes a guide wall 37 forming a pocket 36 that receives the second housing portion 24. The guide wall 37 circumscribes at least a portion of the second housing portion 24 when assembled (best shown in FIG. 6), for example, at least 50%, and in another example, at least 70%, such that the guide wall 37 engages a corresponding amount of the seal 26 (FIG. 10).

Referring to FIGS. 3-5B, the secondary lock 28 includes second apertures 32 that are aligned with the first apertures 30. Secondary lock retaining elements 42 secure the secondary lock 28 to the first housing portion 22 to provide a subassembly. In the example, the secondary lock retaining elements 42 are provided by hooks 44 provided on the guide wall 37. A perimeter 40 of the secondary lock 28 includes tabs 46 that cooperate with the hooks 44. The tabs 46 are slidable relative to the hooks 44 between unlocked (FIG. 4) and locked (FIG. 11) positions. In the example embodiment, four sets of hooks 44 and tabs 46 are provided.

Figure 4:
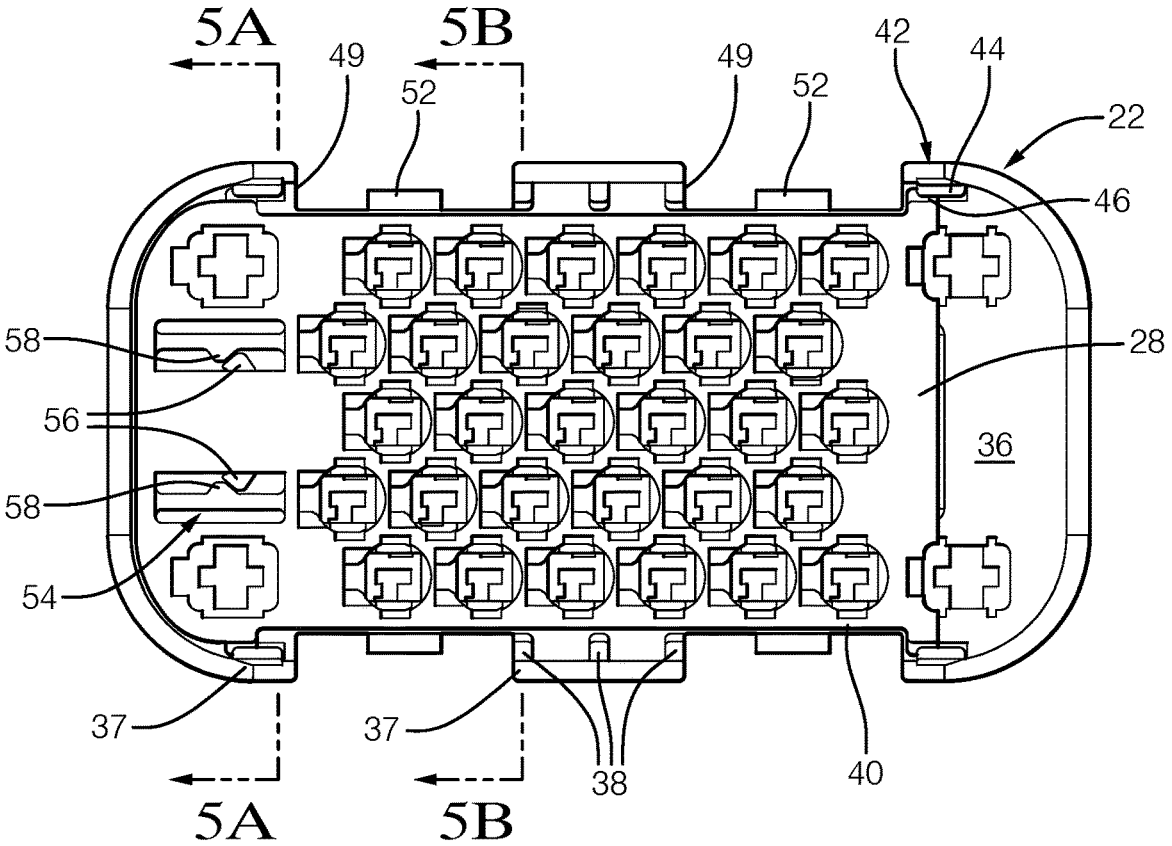
FIG. 4 is an end view of the secondary lock retained in the first housing portion and positioned in an unlocked position.
Figure 5A:
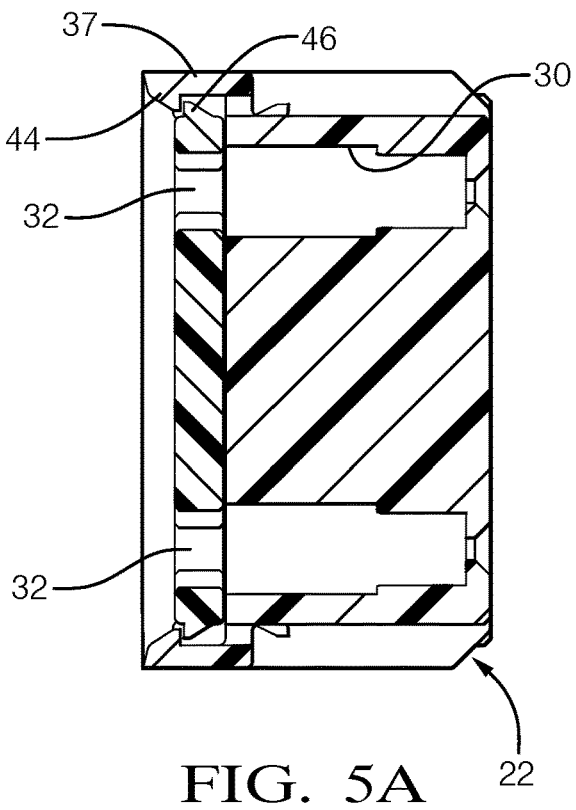
FIG. 5A is a cross-sectional view taken through the first housing portion and the secondary lock along line 5A-5A of FIG. 4.
Figure 5B:
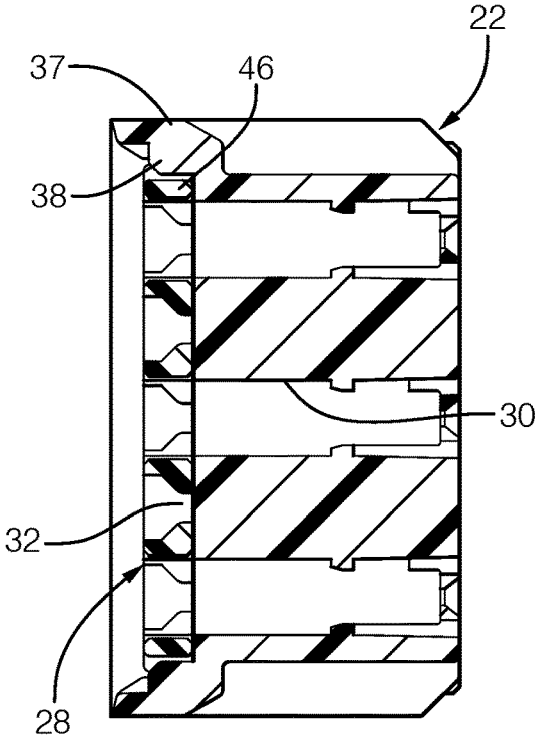
FIG. 5B is a cross-sectional view taken through the first housing portion and the secondary lock along line 5B-5B of FIG. 4.
Figure 6:
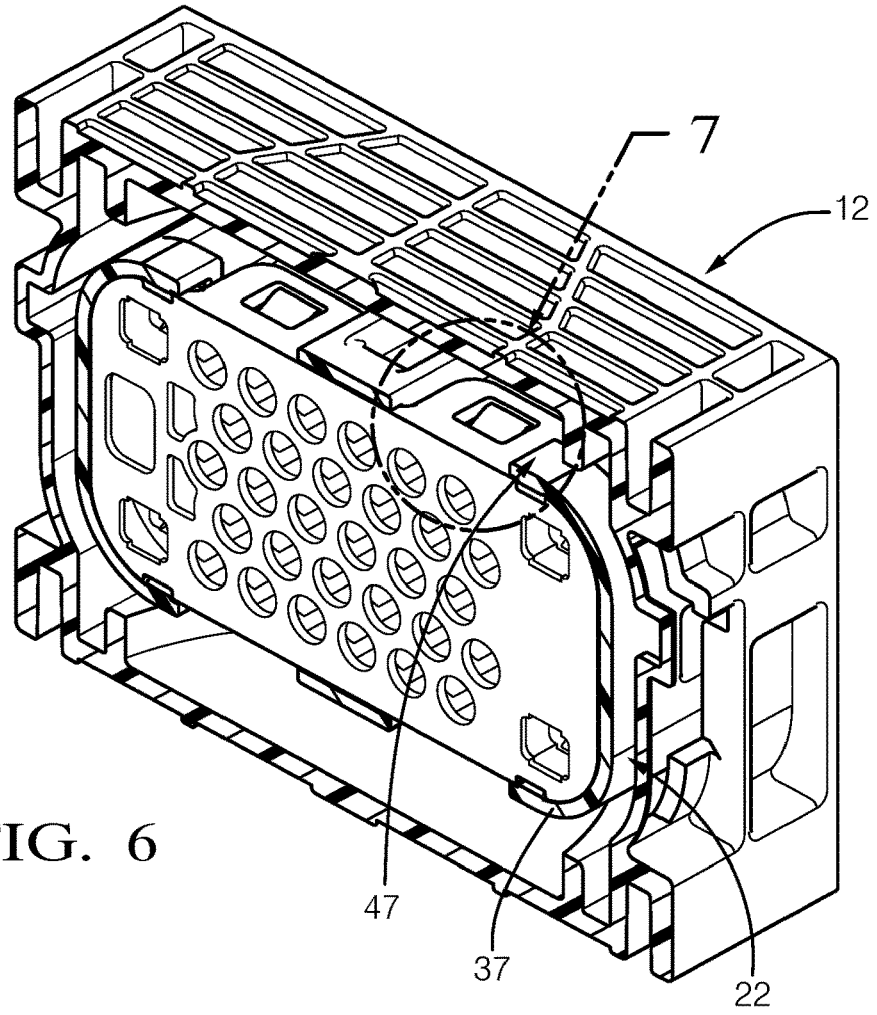
FIG. 6 is a cross-sectional perspective view of the first and second housing portion secured to one another about the secondary lock.
Figure 7:
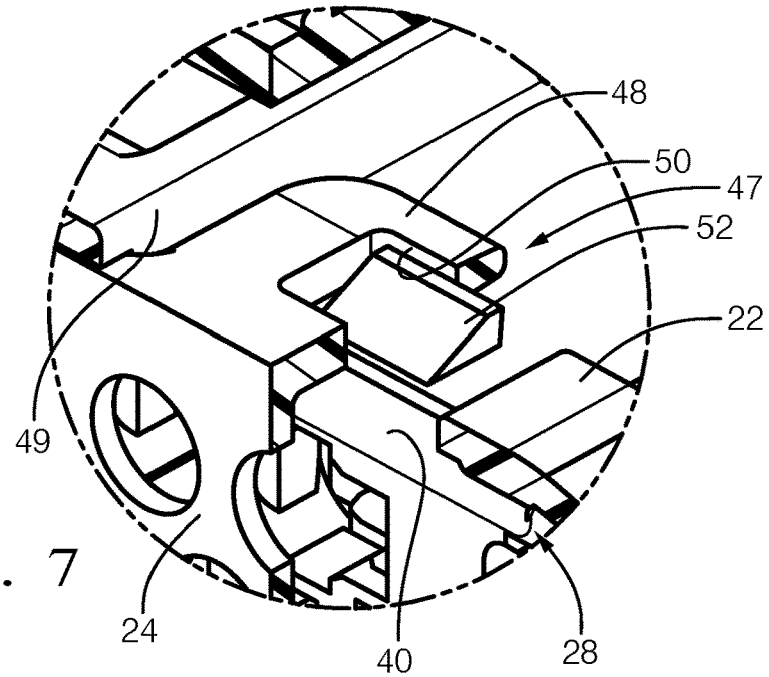
FIG. 7 is an enlarged view of a portion of FIG. 6 illustrating housing locking elements.
Figure 8:
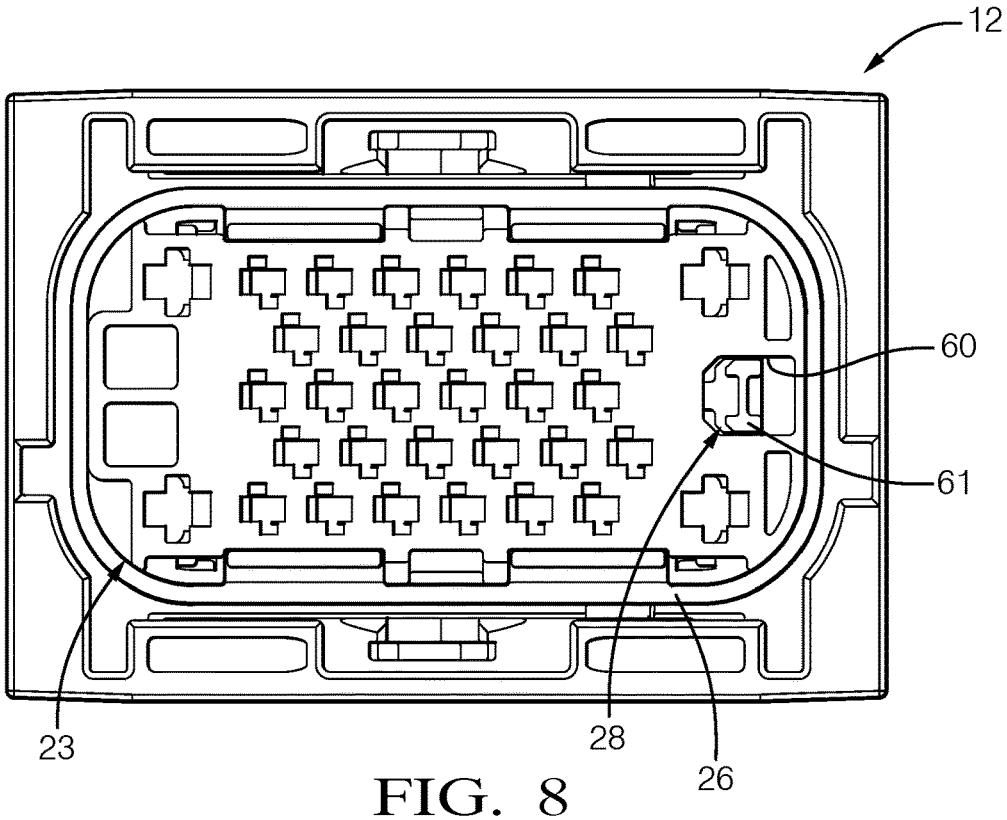
FIG. 8 is an end view of the assembled first connector with the secondary lock in an unlocked position.

Referring to FIGS. 6 and 7, housing locking elements 47 secure the first and second housing portions 22, 24 to one another in a snap fit relationship. The housing locking elements 47 are provided by a clip 48 on the second housing portion 24 that extend through gaps 49 in the guide wall 37 (FIGS. 2, 4, 7). The clip 48 includes a window 50 receiving a tab 52 in the first housing portion 22. Ribs 38 extending inwardly from the guide wall 37, as shown in FIG. 4, help guide the second housing portion 24 into the pocket 36. In the example embodiment, four sets of clips 48 and tabs 52 are provided. The ribs 38 on the guide wall 37 creates a tight fit with the second housing portion 24, preventing floating of the first housing portion 22.

Figure 9:
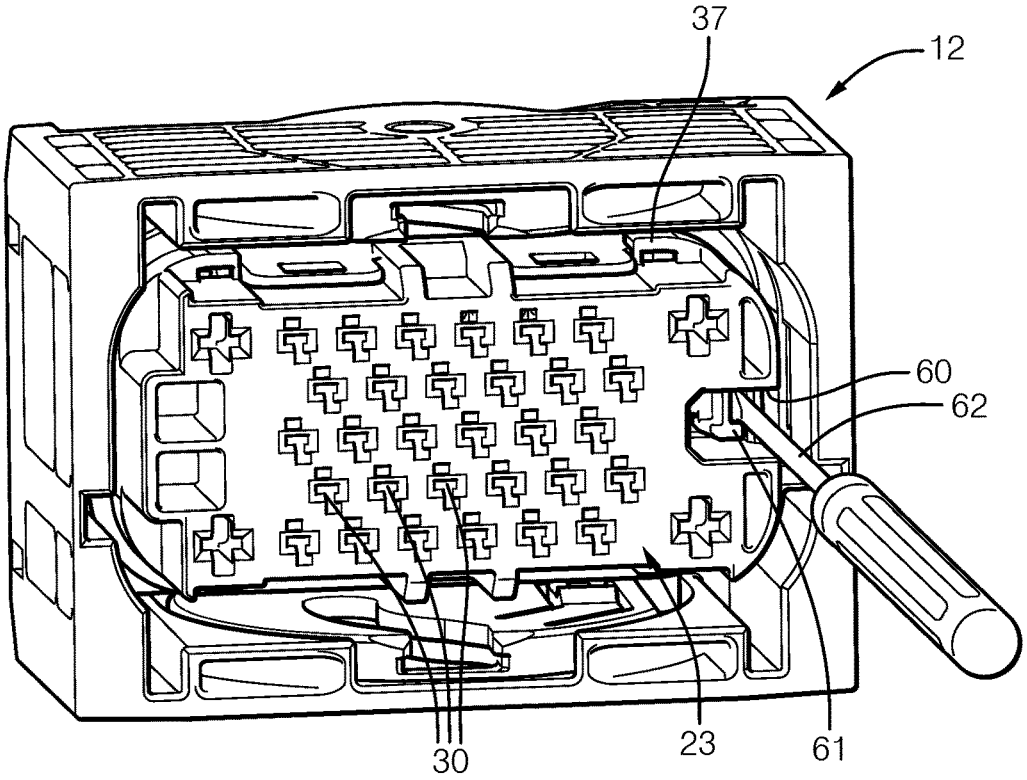
FIG. 9 is an end view of the first housing portion with a tool inserted into an opening to move the secondary lock from the unlocked position to a locked position.
Figure 10:
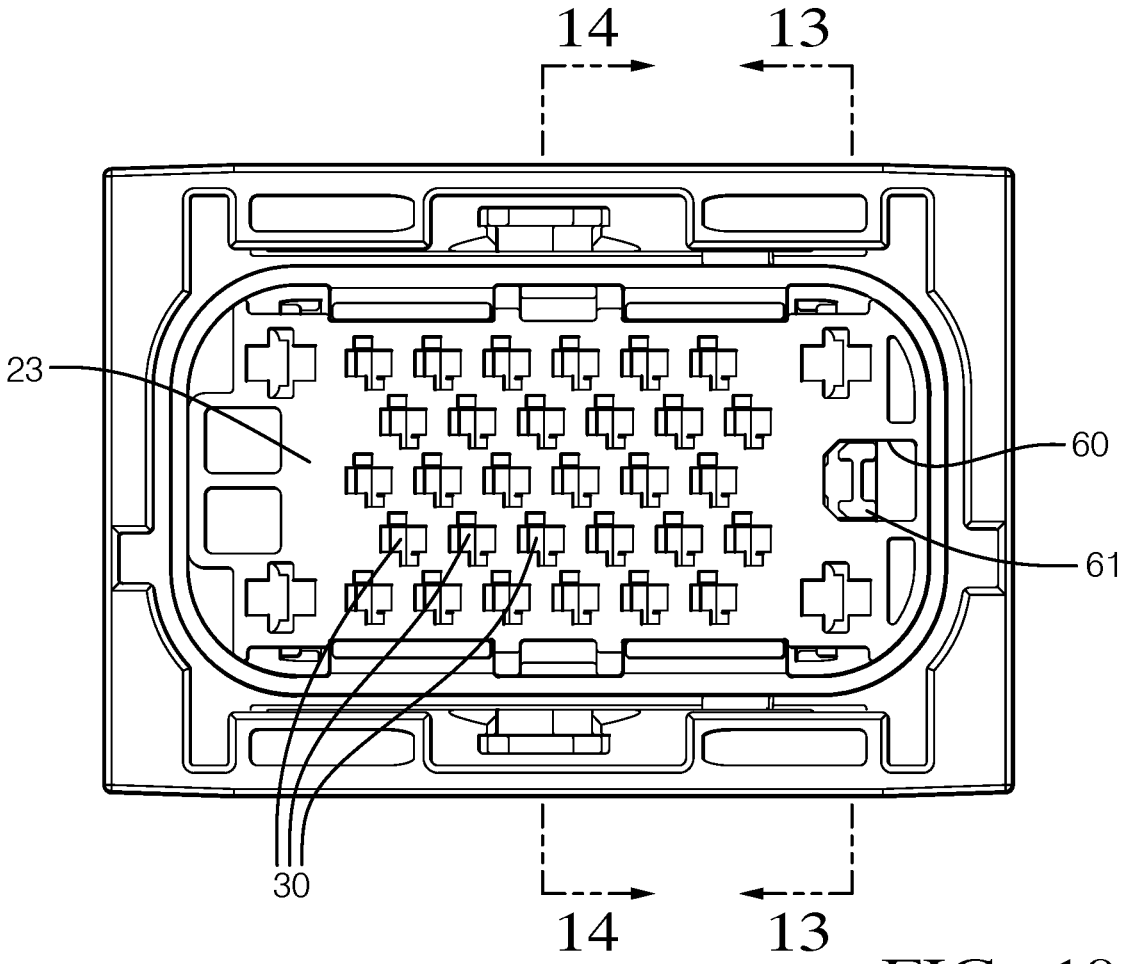
FIG. 10 is an end view of the first connector with the secondary lock in the locked position.
Figure 11:
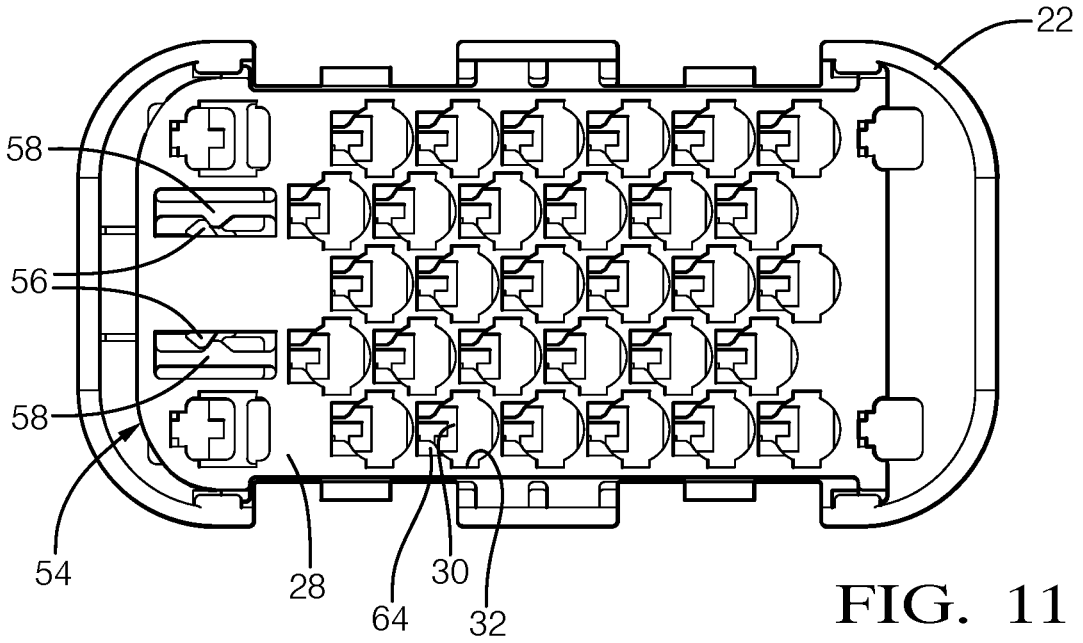
FIG. 11 is an end view illustrating the secondary lock in the locked position with the second housing portion removed.
Figure 12:
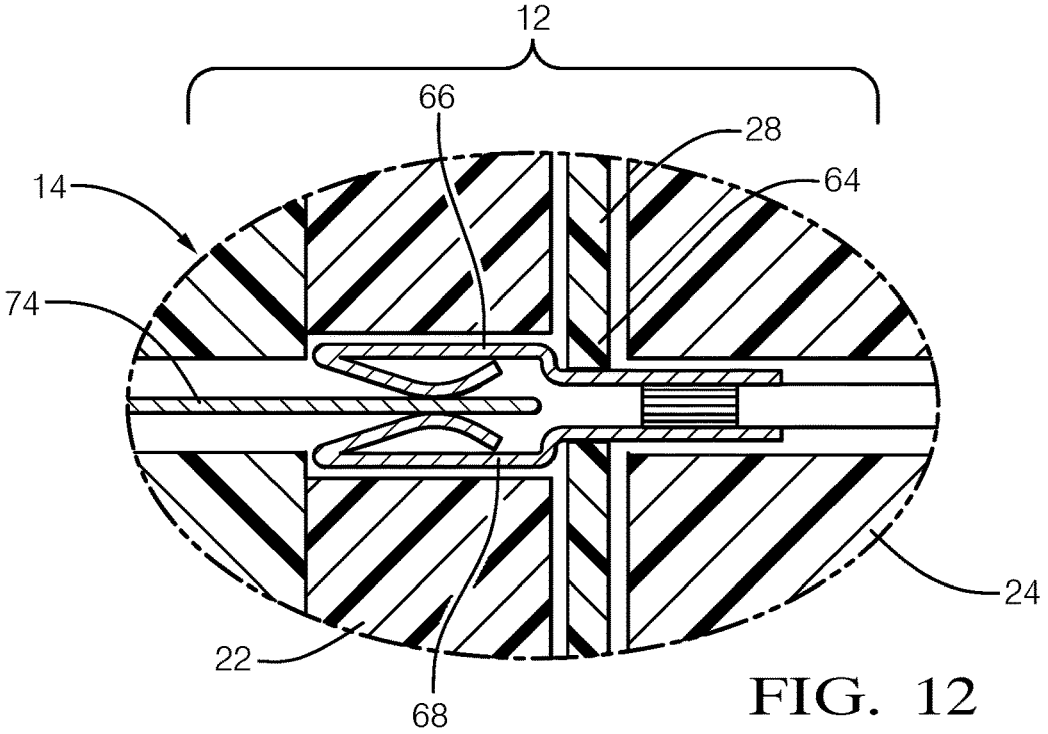
FIG. 12 is a schematic cross-sectional view of the first and second connectors secured to one another to make an electrical connection between a terminal and a second terminal with the secondary lock in the locked position.
Figure 13:
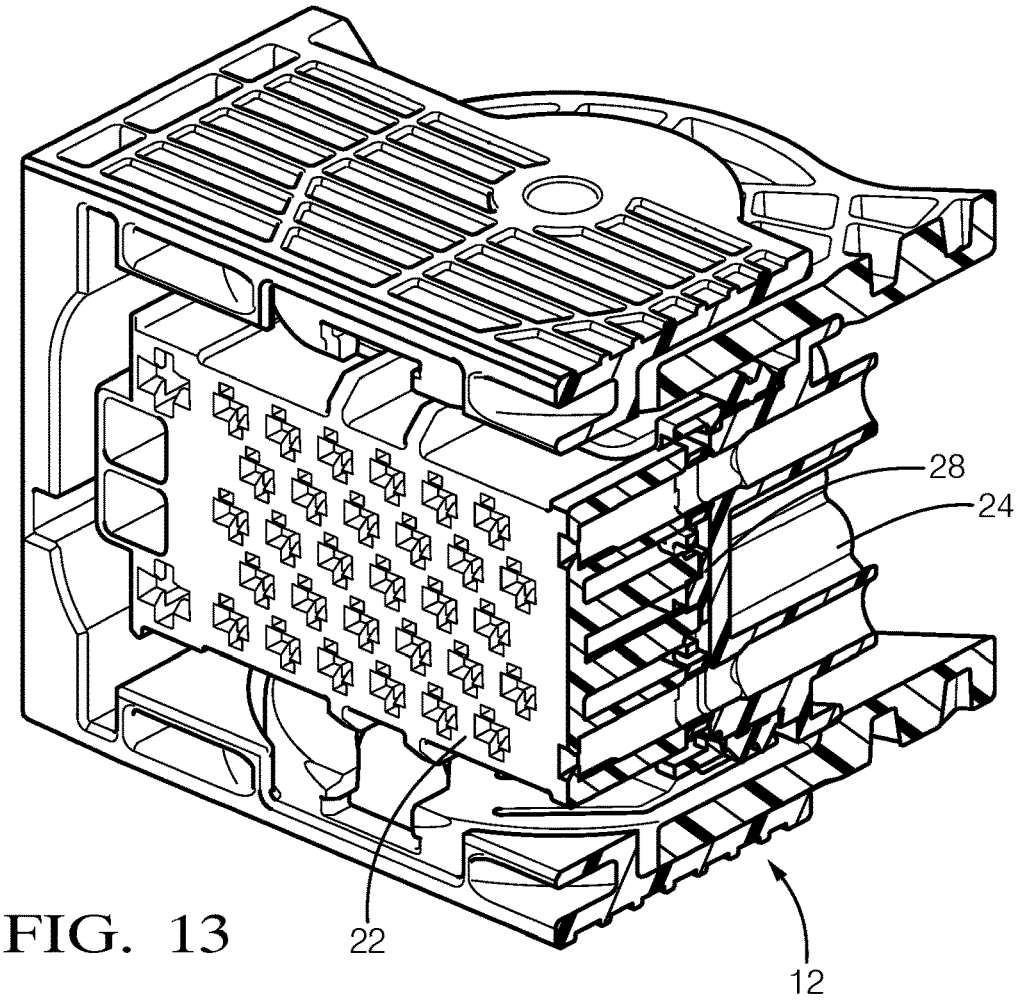
FIG. 13 is a cross-sectional view through the first connector shown in FIG. 10 taken along line 13-13.

Referring to FIGS. 8-11, the first housing portion 22 includes an opening 60 that provides access to an arm 61 extending from the secondary lock 28. A tool 62, as shown in FIG. 9, can be inserted into the opening 60 to cooperate with the arm 61. By pushing the arm 61 leftward as shown in the figures, the secondary lock 28 may be moved from the unlocked position (FIG. 8) to the locked position (FIG. 10). Secondary lock locking elements 54 are provided by first and second protrusions 56, 58 that cooperate with one another. In the locked position, a first set of protrusions 56 on the secondary lock 28 move from one side of second protrusions 58, as illustrated in FIG. 4, to the other side of the second protrusions 58, as illustrated in FIG. 11. In the locked position, lips 64 associated with each aperture 30 of the secondary lock 28, abut and block an endwall 66 of a terminal 68 to provide terminal position assurance, as illustrated in FIG. 12.

Figure 14:
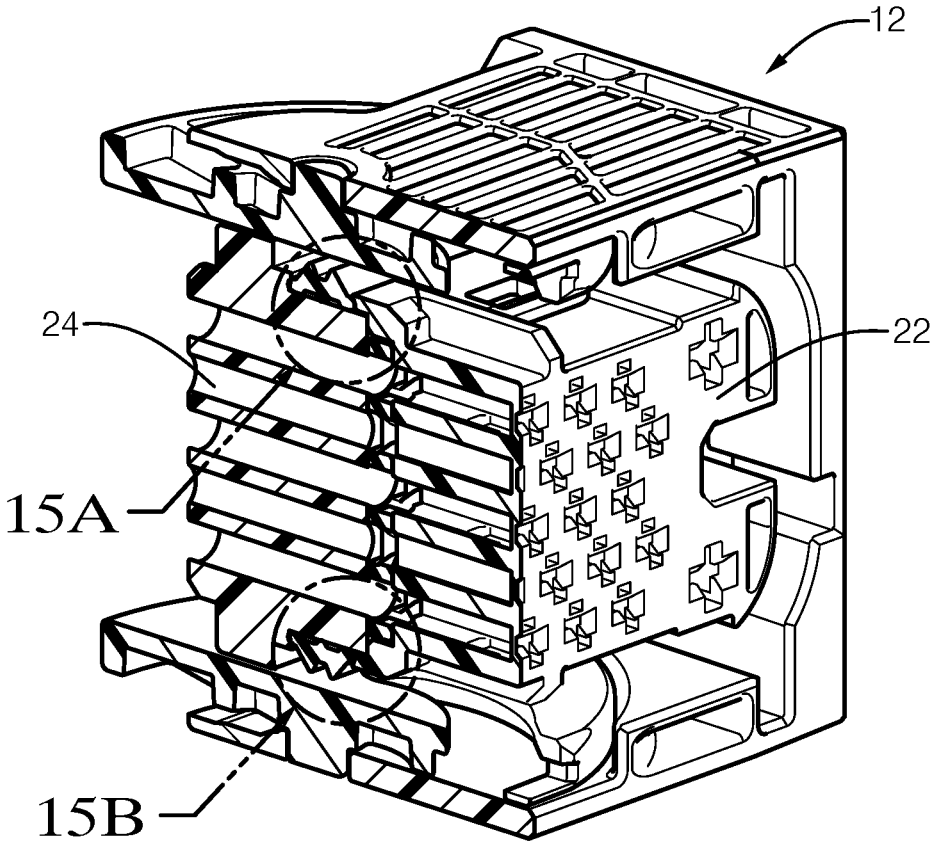
FIG. 14 is a cross-sectional view of the first connector shown in FIG. 10 taken along line 14-14.
Figure 15A:
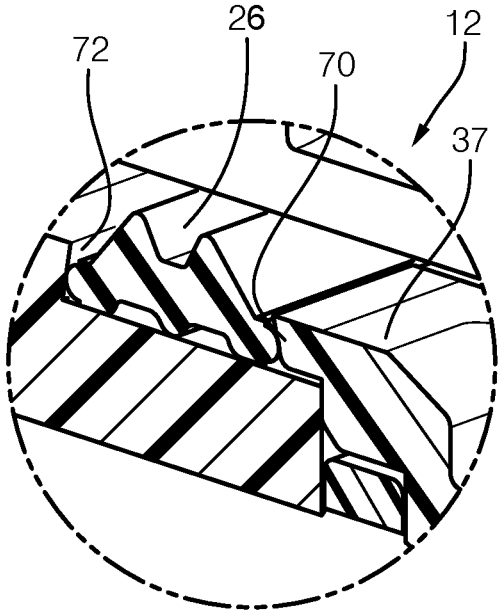
FIGS. 15A and 15B are enlarged, broken cross-sectional views illustrating the seal captured between the first and second housing portions.
Figure 15B:
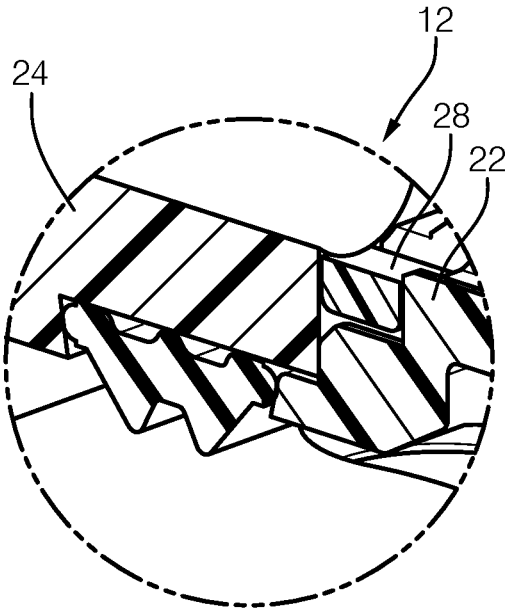

Referring to FIGS. 14, 15A, and 15B, the first and second housing portions 22, 24 respectively provide first and second shoulders 70, 72, which abut the seal 26. Positive contact with the first and second shoulders 70, 72 prevents rollover of the seal 26.

In operation, the electrical connector 10 is assembled by inserting the secondary lock 28 into the first housing portion 22 to provide a subassembly. The secondary lock retaining elements 42 are snapped to one another, and the secondary lock 28 is left in the unlocked position. The seal 26 is arranged on a second housing portion 24.

The first and second housing portions 22, 24 are secured to one another and about the secondary lock 28, capturing the secondary lock 28. During this step, the second housing portion 24 is received in the pocket 36 provided by the guide wall 37. The housing locking elements 47 are snapped together, which captures the seal 26 between the first and second housing portions 22, 24.

A terminal 68 is inserted through each of the first and second apertures 30, 32 and the holes 34 such that the terminals 68 are fully seated in their respective first aperture 30. Insulated wiring extends from the holes 34 at a backside 25 of the second housing portion 24 (FIG. 3). At this point, the tool 62 can be inserted into the opening 60 to force the arm 61 to one side, sliding the secondary lock 28 from the unlocked position to the locked position to block the terminals 68 from pulling past the second aperture 32 with the lips 64 of the secondary lock 28. The second protrusions 58 slide past the first protrusions 56 when moving to the locked position.

The second connector 14 is installed onto the first connector 12, which electrically couples second terminals 74 to the terminals 68 and engages the second connector 14 with the seal 26. The first shoulder 70 and the second shoulder 72 abut and capture the seal 26, preventing seal rollover. The lever 16 is rotated to lock the first and second connectors 12, 14 to one another.

It should also be understood that although a particular component arrangement is disclosed in the illustrated embodiment, other arrangements will benefit herefrom. Although particular step sequences are shown, described, and claimed, it should be understood that steps may be performed in any order, separated or combined unless otherwise indicated and will still benefit from the present invention.

Although the different examples have specific components shown in the illustrations, embodiments of this invention are not limited to those particular combinations. It is possible to use some of the components or features from one of the examples in combination with features or components from another one of the examples.

Although an example embodiment has been disclosed, a worker of ordinary skill in this art would recognize that certain modifications would come within the scope of the claims. For that reason, the following claims should be studied to determine their true scope and content.

What is claimed is:

1. An electrical connector comprising:

first and second housing portions secured to one another and respectively providing an aperture and a hole, the aperture configured to receive a terminal of a wire, the hole configured to receive the wire, the first housing portion including a face configured to mate with another connector carrying another terminal engageable with the terminal;

a seal captured between the first and second housing portions; and a secondary lock carried by the first housing portion and slidable between unlocked and locked positions, wherein the first housing portion includes a guide wall forming a pocket that receives the second housing portion, wherein the secondary lock is provided by a clip on the guide wall and a tab on a perimeter of the secondary lock, and wherein the tab is slidable relative to the clip between the locked and unlocked positions.

2. The connector of claim 1, wherein the guide wall circumscribes at least a portion of the second housing portion.

3. The connector of claim 2, wherein the first and second housing portion including complementary housing locking elements securing the first and second housing portions to one another in a snap-fit relationship.

4. The connector of claim 3, wherein the housing locking elements are provided by the clip with a window on one of the first and second housing portions and a tab on the other of the first and second housing portions that is received in the window.

5. The connector of claim 4, wherein the guide wall includes a gap configured to receive the clip, the tab provided on the first housing portion, and the guide wall abuts at least 50% of the seal.

6. The connector of claim 1, wherein the secondary lock is configured to abut the terminal in the locked position and configured to permit insertion of the terminal into the aperture in the unlocked position.

7. The connector of claim 1, wherein the guide wall circumscribes at least a portion of the second housing portion.

8. The connector of claim 7, wherein the first housing and the secondary lock respectively include first and second protrusions, the second protrusion arranged on one side of the first protrusion in the unlocked position, and the second protrusion arranged on an opposing side of the one side in the locked position.

9. The connector of claim 6, comprising the terminal arranged in the aperture, the aperture corresponding to a first aperture, and the secondary lock includes an opening and including a second aperture providing a lip, the opening configured to receive a tool that moves the secondary lock from the unlocked position to the locked position, the lip blocking the terminal in the locked position.

10. A method of assembling an electrical connector having a first housing portion and a second hosing portion, wherein the first housing portion includes a guide wall forming a pocket that receives the second housing portion, the method comprising:

inserting a secondary lock provided by a clip on the guide wall and a tab on a perimeter of the secondary lock into a first housing portion to provide a subassembly;

arranging a seal on a second housing portion;

securing the first and second housing portions to one another and about the secondary lock; and capturing the seal between the first and second housing portions in response to the securing step.

11. The method of claim 10, wherein the first housing portion and the secondary lock respectively include first and second apertures aligned with one another, comprising a terminal arranged in the first aperture, and comprising a step of sliding the secondary lock from an unlocked position to a locked position to block the terminal from pulling past the second aperture with the secondary lock.

12. The method of claim 11, wherein the sliding step including sliding a second protrusion past a first protrusion to the locked position.

13. The method of claim 10, wherein the inserting step includes snapping secondary lock retaining elements to one another.

14. The method of claim 10, wherein the securing step includes receiving the second housing portion in the pocket provided by the guide wall of the first housing portion, wherein the guide wall provides a first shoulder and the second housing portion provides a second shoulder, the capturing step includes abutting the seal with the first and second shoulders.

15. The method of claim 14, wherein the securing step includes snapping housing locking elements to one another.

16. The method of claim 10, comprising a step of installing a second connector with a second terminal into the connector, the installing step includes electrically coupling the second terminal to the terminal and engaging the second connector with the seal.

17. The method of claim 16, comprising a step of rotating a lever to lock the connector and the second connector to one another.

18. An electrical connector comprising:

first and second housing portions secured to one another and respectively providing an aperture and a hole, the aperture configured to receive a terminal of a wire, the hole configured to receive the wire, the first housing portion including a face configured to mate with another connector carrying another terminal engageable with the terminal; and a secondary lock carried by the first housing portion and slidable between unlocked and locked positions, wherein the first housing portion includes a guide wall forming a pocket that receives the second housing portion, wherein the secondary lock is provided by a clip on the guide wall and a tab on a perimeter of the secondary lock, and wherein the tab is slidable relative to the clip between the locked and unlocked positions.

19. The connector of claim 18, wherein secondary lock retaining elements secure the secondary lock to the first housing portion to provide a subassembly, wherein the guide wall circumscribes at least a portion of the second housing portion and wherein the first housing and the secondary lock respectively include first and second protrusions, wherein the second protrusion is arranged on one side of the first protrusion in the unlocked position, and wherein the second protrusion is arranged on an opposing side of the one side in the locked position.

20. The connector of claim 18, wherein the second protrusion is arranged on one side of the first protrusion in the unlocked position and wherein the second protrusion is arranged on an opposing side of the one side in the locked position.

* * * * *